US011066785B2

(12) United States Patent
Sharoyan et al.

(10) Patent No.: US 11,066,785 B2
(45) Date of Patent: Jul. 20, 2021

(54) METHOD FOR IMPROVING FABRIC RELEASE IN STRUCTURED SHEET MAKING APPLICATIONS

(71) Applicant: SOLENIS TECHNOLOGIES, L.P., Wilmington, DE (US)

(72) Inventors: Davit E. Sharoyan, Hockessin, DE (US); Doeung David Choi, Hockessin, DE (US)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 15 days.

(21) Appl. No.: 16/381,033

(22) Filed: Apr. 11, 2019

(65) Prior Publication Data

US 2020/0325627 A1 Oct. 15, 2020

(51) Int. Cl.

| | |
|---|---|
| ***D21F 11/14*** | (2006.01) |
| ***D21H 27/00*** | (2006.01) |
| ***D21H 21/24*** | (2006.01) |
| ***D21H 21/14*** | (2006.01) |

(52) U.S. Cl.

CPC ..... *D21F 11/145* (2013.01); *D21H 21/24* (2013.01); *D21H 27/002* (2013.01); *D21H 21/146* (2013.01)

(58) Field of Classification Search

CPC .... D21H 21/146; D21H 27/002; D21H 21/24; D21H 17/06; D21H 17/07; D21H 21/14; D21F 11/14; D21F 11/145

See application file for complete search history.

(56) References Cited

U.S. PATENT DOCUMENTS

| | | | | |
|---|---|---|---|---|
| 5,660,687 | A * | 8/1997 | Allen | B31F 1/12 162/111 |
| 6,017,417 | A * | 1/2000 | Wendt | D21F 1/0027 162/109 |
| 6,139,911 | A * | 10/2000 | Vanhecke | C10M 173/00 106/2 |
| 6,468,394 | B1 * | 10/2002 | Sekiya | D21F 3/02 106/2 |
| 6,558,513 | B1 * | 5/2003 | Pease | C08F 10/10 106/2 |
| 6,743,334 | B2 * | 6/2004 | Klerelid | B65H 19/28 162/118 |
| 6,827,818 | B2 * | 12/2004 | Farrington, Jr. | B32B 29/00 162/123 |
| 6,921,460 | B2 * | 7/2005 | Hermans | D21F 1/48 162/289 |

(Continued)

FOREIGN PATENT DOCUMENTS

| | | | | |
|---|---|---|---|---|
| WO | WO-2007070124 | A1 * | 6/2007 | D21F 11/145 |
| WO | WO-2008068651 | A2 * | 6/2008 | D21H 21/18 |
| WO | WO-2020210424 | A1 * | 10/2020 | D21H 27/002 |

OTHER PUBLICATIONS

Wikipedia "Microemulsions" retrieved on Nov. 12 (Year: 2020).*

(Continued)

*Primary Examiner* — Jose A Fortuna

(74) *Attorney, Agent, or Firm* — Lorenz & Kopf, LLP

(57) ABSTRACT

A method is provided for the improvement of fabric release in applications such as tissue and towel making processes. The method comprises applying a micro-emulsion of hydrophobic agents and surfactants to the surface of a structured fabric used in sheet making applications of a tissue machine.

13 Claims, 2 Drawing Sheets

(56) References Cited

U.S. PATENT DOCUMENTS

Figure 1:
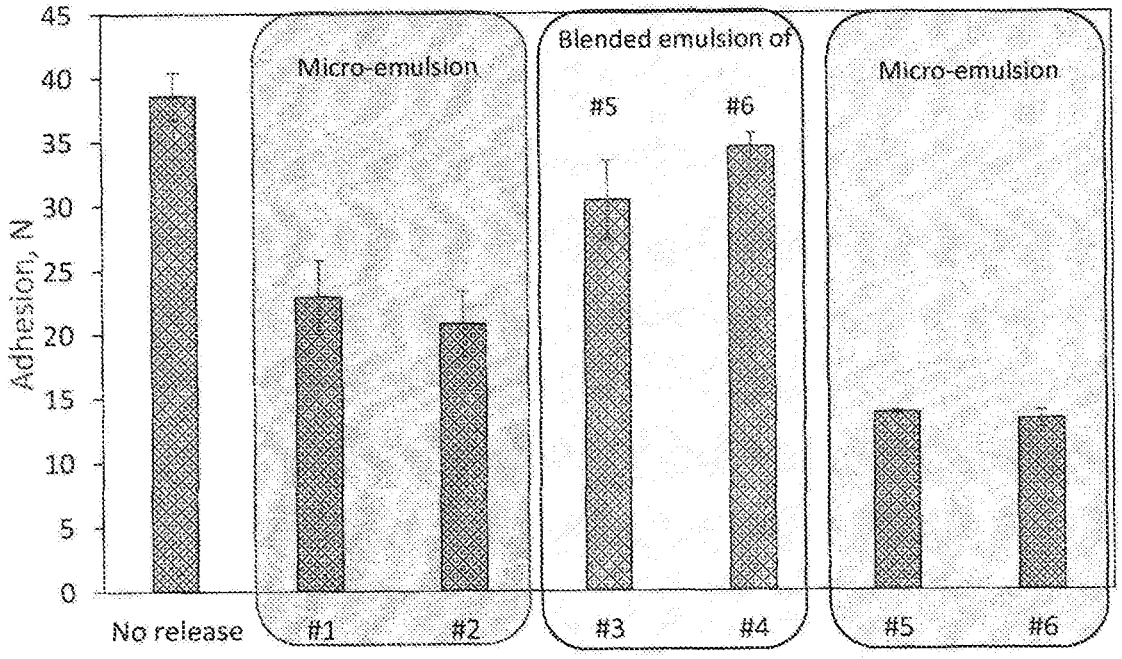

| | | | | |
|---|---|---|---|---|
| 7,404,875 | B2 | 7/2008 | Clungeon et al. | |
| 7,972,474 | B2 * | 7/2011 | Underhill | D21F 11/14 162/111 |
| 8,071,667 | B2 | 12/2011 | Furman, Jr. et al. | |
| 8,366,878 | B2 * | 2/2013 | Klerelid | D21F 11/006 162/116 |
| 8,865,263 | B2 * | 10/2014 | Sharoyan | D21F 3/02 427/425 |
| 9,267,239 | B2 * | 2/2016 | Dilkus | D21H 21/146 |
| 9,945,076 | B2 * | 4/2018 | Choi | B31F 1/12 |
| 2004/0206465 | A1 * | 10/2004 | Farrington, Jr. | D21H 27/30 162/123 |
| 2005/0006039 | A1 * | 1/2005 | Farrington, Jr. | D21H 25/005 162/109 |
| 2005/0006040 | A1 * | 1/2005 | Boettcher | D21H 21/146 162/111 |
| 2005/0241791 | A1 | 11/2005 | Wolkowicz et al. | |
| 2011/0297341 | A1 * | 12/2011 | Dilkus | B31F 1/12 162/111 |
| 2012/0045587 | A1 * | 2/2012 | Sharoyan | D21H 25/04 427/427.7 |
| 2013/0048238 | A1 | 2/2013 | Glover et al. | |
| 2014/0314962 | A1 * | 10/2014 | Choi | D06M 13/02 427/421.1 |
| 2016/0168798 | A1 * | 6/2016 | Choi | D21F 5/02 162/111 |
| 2017/0284029 | A1 * | 10/2017 | Hermans | D21H 27/002 |
| 2017/0298574 | A1 * | 10/2017 | Ramaratnam | D21H 21/14 |
| 2017/0314206 | A1 * | 11/2017 | Sealey, II | D21H 21/14 |
| 2018/0149779 | A1 * | 5/2018 | Choi | D06M 15/643 |
| 2019/0055695 | A1 * | 2/2019 | Wu | B31F 1/12 |
| 2019/0292729 | A1 * | 9/2019 | Tan | D21F 5/184 |
| 2020/0325627 | A1 * | 10/2020 | Sharoyan | D21H 21/24 |

OTHER PUBLICATIONS

Müller et al. in "Particle Size Distributions and Particle Size Alterations in Microemulsions," Journal of Pharmaceutical sciences, vol. 73, No. 7, pp. 919-922. (Year: 1984).*

ISA/US, International Search Report and Written Opinion issued in Int. Appl. No. PCT/US2020/027368 dated Jun. 24, 2020.

* cited by examiner

METHOD FOR IMPROVING FABRIC RELEASE IN STRUCTURED SHEET MAKING APPLICATIONS

TECHNICAL FIELD

The present disclosure relates to a method for the improvement of fabric release in applications such as tissue and towel making processes. The method comprises applying a micro-emulsion of hydrophobic agents and surfactants and treating the surface of the fabric during structured sheet making processes.

BACKGROUND

A tissue making process for the manufacture of products such as facial tissue, bathroom tissue and paper towels involves the formation of a tissue web from an aqueous slurry of pulp and chemical additives followed by the removal of water from the tissue web. Partial removal of water from the tissue web occurs as the tissue web is transferred from a forming fabric onto a structured fabric. Final water removal is then accomplished by pressing the tissue onto, for example, a Yankee cylinder or Yankee drier, which terms are used interchangeably herein.

Tissue paper is typically produced by Dry Crepe and Through Air Drying (TAD) processes. However, Through Air Drying (TAD) is different from the Dry Crepe process in that in a TAD process a tissue web is transferred from a forming fabric onto a structured fabric, such as, a TAD fabric surface, a papermaking belt surface, a textured belt or structured belt surface, all of which have a 3-dimensional character. The structured fabric is a woven structure of yarns that are mainly made of polymeric materials. Typical polymeric material for yarns is polyethylene terephthalate (PET). Shortly after the tissue web is transferred to the structured fabric, it goes through a moulding box where the sheet is pulled onto the structured fabric under high vacuum to give the tissue sheet structure and pattern, so that when dry, the pattern remains in the tissue.

The tissue web on the structured fabric goes through an operation wherein hot air blows through the tissue web and the structured fabric, partially removing about 60% to 90% of the water from the tissue web to form a structured, imprinted or patterned tissue paper. The structured or patterned tissue paper is transferred to a Yankee cylinder for further drying and creping. The TAD process allows for a generation of higher quality tissue with increased bulk and softness, higher strength and absorption.

Upon the reduction of water content, fibers come into close proximity with each other and the degree of association and bonding grows significantly. However, pulp fibers not only adhere to each other but also tend to adhere to the fabric that is made of polymeric yarns during the "moulding" process under the high vacuum that typically ranges from 15 inches Hg to 25 inches Hg. However, due to potential degradation of fabric materials and general wear and tear, the adhesion between tissue fibers and the fabric can and will increase as the time of service of the fabric increases. Increased tissue adhesion onto the structured fabric surface is not desirable since it may create fiber deposits on the fabric surface, and complications in tissue release from the fabric and its further transfer to and from, for example, the Yankee drier. This makes the modification in fabric cover materials over time less effective. To avoid these undesirable effects, a number of treatments have been utilized including modifications in fabric cover materials, and/or application of various fabric release agents to aid in the separation of the tissue from the fabric.

Recent advances in the area of tissue manufacture offer benefits of achieving high bulk that the TAD process provides with the speed and energy efficiency of Dry Crepe Tissue (DCT) process such as Metso's NTT process using a textured belt and Voith's Advance Tissue Molding System (ATMOS) process which uses a textured or structured fabric. These textured belts which are made of polymeric materials often need fabric release products or agents since a tissue web can adhere to the belts and may not be transferred to a Yankee dryer easily causing inconsistent quality in the final product.

Older generation TAD fabric release products have been formulated with mineral and/or vegetable oils or products of petrochemical origin. While they provide release properties, these products can have undesirable characteristics in the tissue making process causing thermal degradation, smoking, potentially fires and environmental issues. The applications of these chemistries can be quite complex since hydrophobic materials added to an aqueous system creates an unstable system causing disruptions in the tissue making process resulting in a product of inconsistent quality.

Accordingly, it is desirable to provide methods for improving the release of a tissue web from a structured fabric. It is also desirable to provide high performance fabric release compositions that improve the release of tissue webs from structure fabric in tissue making operations. Furthermore, other desirable features and characteristics of the present disclosure will become apparent from the subsequent detailed description and the appended claims, taken in conjunction with the accompanying drawings and this background.

SUMMARY

The present method relates to reducing the adhesion between a tissue web and surfaces found in a tissue making process. Methods have been found that improve the release of a tissue web from a structured fabric surface of a supporting medium resulting from reducing the adhesion between a tissue web and a structured fabric surface. The method includes providing or preparing a micro-emulsion comprising at least one hydrophobic agent and at least one surfactant. The at least one hydrophobic agent and at least one surfactant are homogenized prior to or subsequent to being combined, generating a micro-emulsion having a mean particle size ranging from about 1 μm to 0.1 μm. The micro-emulsion is then applied to the surface of the structured fabric, and the surface of the structured fabric is placed in contact with the tissue web. The tissue web continues through the tissue making process to produce a finished tissue product.

BRIEF DESCRIPTIONS OF THE DRAWINGS

The present invention will hereinafter be described in conjunction with the following drawing figures.

FIG. 1—illustrates the improved release properties of the current micro-emulsion.

Figure 2:
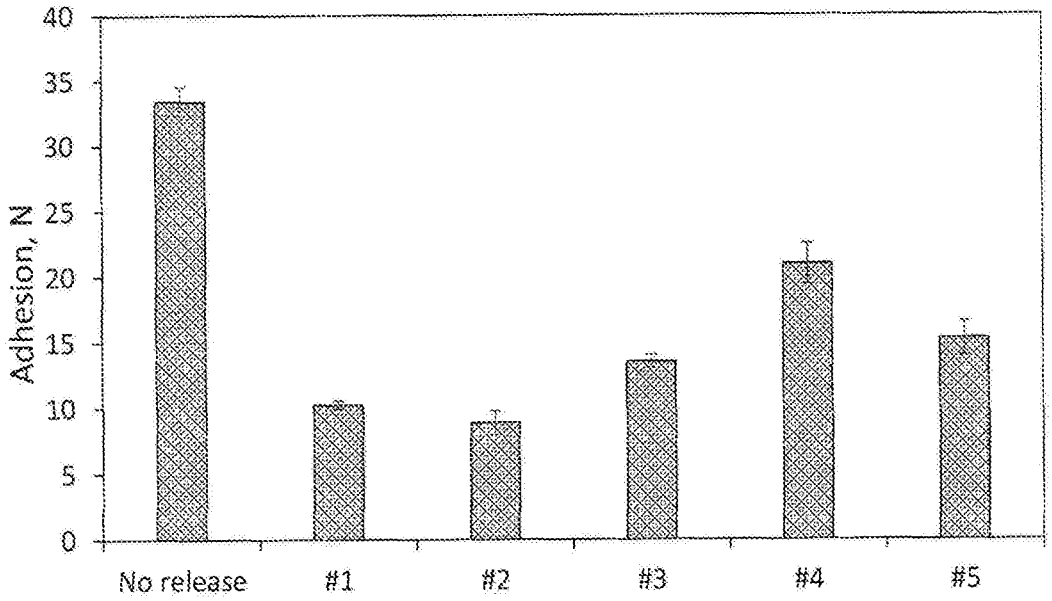

FIG. 2—illustrates the improved adhesion reduction of the current micro-emulsion.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

High performance fabric release compositions and methods that significantly improve the release of a tissue web from a structured fabric in a tissue making operation are provided herein. The compositions and methods produce a more consistent structured tissue product having increased bulk and softness as well as higher strength and absorption. In some aspects, the present disclosure relates to a method for the reduction in adhesion between a tissue web and a structured fabric surface in a tissue making process wherein a high performance fabric release composition is employed. The high performance fabric release compositions as contemplated herein are micro-emulsions, which are prepared using at least one hydrophobic agent and at least one surfactant. A hydrophobic agent as defined herein, comprises those agents having a solubility of less than 1 gram per liter (g/L) of water at 20° C. Their molecules usually contain one or several, short or long hydrocarbon chains of —(—CH2—)n-CH3 and usually dissolve in organic (non-polar) solvents.

In embodiments, the hydrophobic agents and surfactants are homogenized and combined or combined and homogenized to form a single micro-emulsion product. The hydrophobic agents and surfactants may be subjected to an emulsifying process, such as application of high pressure and/or sheer to generate a micro-emulsion wherein the mean particle size of the composition is about 1 micron (μm) or less as measured by a Horiba Particle Size Analyzer LA 300. When one or more liquids are homogenized using high pressure, the liquid or blended liquids are pushed or forced through a small orifice or chamber using high pressure. High pressure is generated by the size of the orifice, a higher flow rate, or a combination thereof. The orifice is generally adjustable and the amount of pressure can be regulated in this regard. The smaller orifice will generate higher pressure as the mixture passes through the orifice generating smaller particles. However, there are physical and chemical limitations of a formulation wherein the particle size reaches a minimum size. Typically, most liquids can be emulsified using pressures of from about 2000 pounds per square inch (psi) to 3000 psi but can be pressures up to 20000 psi. This pressure will generate intense energy to break apart large particles into very small particles. Thus, the blended materials are homogenized. Two such homogenizers are the Gaulin Homogenizer (SPX Corporation, Charlotte, N.C.) and Microfluidizer (Microfluidics, Westwood, Mass.), but there are many other devices that could serve as a homogenizer. The size of particles depends on the level of pressure, types of emulsifiers and ratio of the materials. Once the micro-emulsion is generated, it is diluted down with water and then is applied onto a structured fabric surface thereby allowing a tissue web to release easier and more efficiently in a tissue manufacturing process. The emulsified formulation reduces adhesion between the tissue web and structured fabric surface. When the hydrophobic agents are applied to the tissue web, absorbency and strength of the product will be negatively affected, resulting in lower absorption, which is especially undesirable in towel production, and lower strength.

In a typical tissue operation, additives used in the treatment of the structured fabric surface are mixed in a mixing tank or inline mixer. Through extensive studies we have found that if a hydrophobic agent and surfactant is homogenized into a micro-emulsion of about 1 micron or less, the stability and performance of the current composition is significantly improved. By micro-emulsion we mean that the combination of hydrophobic agents and surfactants are subjected to enough external force, such as high pressure and/or high shear, which results in a homogenization of the two or more components of the current composition resulting in a single "micro-emulsion" having a mean particle size of from about 1 micron to about 0.1 micron, and can be from about 0.5 μm to about 0.3 μm. The combination of creating a micro-emulsion of at least one hydrophobe, at least one surfactant and applying the micro-emulsion to the surface of the structured fabric resulted in unexpected and significantly improved release properties.

By creating a micro-emulsion with the hydrophobes and surfactants, the stability and the release performance of the emulsions generated by simple mixing or blending and having a mean particle larger than 1 micron were greatly increased. The small size of the hydrophobic particles in oil-in-water micro-emulsions tended to improve their stability. Unexpectedly, when a second hydrophobic agent with dual hydrophobic-hydrophilic nature was homogenized with the first hydrophobic release agent, further improvement in stability and performance was realized.

Yankee dryer operations require additives having much different properties than used in formulations in through-air-drying (TAD) applications. Yankee dryer operations take place at the dry end of the creping operation removing any excess water and the surface of the Yankee dryer is metal, such as cast iron and steel. In tissue release applications the surface of concern is a structured fabric surface found at the wet end or sheet forming section of the operation. In the application of interest, a tissue web is transferred from a forming fabric onto a structured fabric, such as, a TAD fabric surface, a papermaking belt surface, a textured belt or structured belt surface, all of which have a 3-dimensional character. The structured fabric is a woven structure of yarns that are mainly made of polymeric materials. Typical polymeric material for yarns is polyethylene terephthalate (PET).

In a through-air-drying (TAD) process, the structured fabric surface is polymeric and much more hydrophobic than the Yankee drier metal surface. Therefore, different issues and problems arise than found in Yankee dryer applications. Other factors associated with Yankee dryer applications is that a release product has to interact with other chemicals in the "coating" of the metal surface of the Yankee dryer, such as adhesives and modifiers, while in tissue applications, such as TAD, one or more release products are the only chemicals that are applied on the polymeric surface to reduce bonding issues between the pulp fibers and the polymeric surface. In Yankee dryer applications, there is a certain degree of interaction or adhesion between the paper web and the Yankee dryer, which would cause issues in TAD applications, where you want little or no adhesive interaction between the tissue web and the structured fabric surface.

Our studies indicated that certain hydrophobic materials, such as mineral or vegetable oils, could help the release of a tissue web from a structured fabric surface, such as found in the TAD process., but their effect were insignificant or short lived. However, when materials with dual nature (containing both hydrophobic and hydrophilic structures) were incorporated into the composition with one more other hydrophobes and/or one or more surfactants, the composition provided for better release and more lasting release effect.

In one aspect of the current method, the hydrophobe(s) and surfactant(s) are homogenized to create a micro-emulsion of the hydrophobic agent(s) or hydrophobe(s) and surfactant(s) having a mean particle size of from 1 μm to about 0.1 μm and can be from about 0.5 μm to about 0.3 μm.

In another aspect of the current method, the micro-emulsion comprising hydrophobic agents and surfactants includes one or more compounds selected from one or more hydrophobic materials, one or more surfactants, and mixtures thereof.

In yet another aspect of the current method, hydrophobic agents are selected from the group consisting of compounds having dual hydrophobic-hydrophilic nature, such as hydrophobically modified polyethylene glycol, hydrophobically modified polyaminoamides, or a combination thereof. The hydrophobe can also be selected from mineral oils, vegetable oils, fatty acid esters, natural or synthetically derived hydrocarbons, natural or synthetically derived wax, Carnauba wax, hydrolyzed AKD, polyethylene homopolymers, polypropylene homopolymers, ethylene-acrylic acid copolymers, ethylene maleic anhydride copolymers, propylene maleic anhydride copolymers, oxidized polypropylene homopolymers, oxidized polyethylene homopolymers and combinations thereof. The surfactant can be anionic, cationic, or non-ionic as long as a micro-emulsion is created having a mean particle size of less than 1 micron.

In some aspects of the current method, the adhesion between a tissue web and a structured fabric surface, such as a TAD fabric surface in a tissue making process is reduced when compared with other known chemical formulations. The method includes providing a micro-emulsion comprising at least two hydrophobic agents and at least one surfactant, wherein the micro-emulsion has a mean particle size of about 1 μm or less. The resulting micro-emulsion composition is applied to the structured fabric surface reducing the adhesion between the tissue web and the structured fabric surface producing a more consistent tissue product. Although the micro-emulsion can be applied to the tissue web for improved release, it would defeat the purpose of making tissue and/or towel products because when the hydrophobic agents are applied to the tissue web, absorption and strength of the product will be negatively affected resulting in lower absorption (not good for towel especially) and lower strength properties.

In some aspects of the current method, the micro-emulsion comprises a first hydrophobically modified material, a second hydrophobically modified material, and/or surfactant. In preferred embodiments, the first hydrophobically modified agent or material can be selected from hydrophobically modified polyethylene glycol, or hydrophobically modified polyaminoamides, or a combination of hydrophobically modified polyethylene glycol, and the second hydrophobically modified material, in addition to those mentioned above, can be selected from mineral oils, vegetable oils, fatty acid esters, natural or synthetically derived hydrocarbons, natural or synthetically derived wax, Carnauba wax, hydrolyzed AKD, polyethylene homopolymers, polypropylene homopolymers, ethylene-acrylic acid copolymers, ethylene maleic anhydride copolymers, propylene maleic anhydride copolymers, oxidized polypropylene homopolymers, oxidized polyethylene homopolymers and combinations thereof. The surfactant can be anionic, cationic, or non-ionic. In preferred embodiments, the surfactant is selected from linear alcohol ethoxylated, branched alcohol ethoxylated, polyethylene glycol mono or diester fatty acids, polyethylene glycol alkyl ethers, and combinations thereof.

In other aspects of the method, the hydrophobic agent(s) and the at least one surfactant are combined and then homogenized to produce the micro-emulsion.

In other aspects of the method, the at least one hydrophobic agent comprises a hydrophobically modified polyethylene glycol.

In yet other aspects of the method, the at least one hydrophobic agent comprises a hydrophobically modified polyethylene glycol the at least one surfactant is a non-ionic surfactant.

In other aspects of the method, the at least one hydrophobic agent comprises from about 50% by dry wt. to about 99.9% by dry wt. and may be 50% to 90% by dry wt. of the microemulsion and the at least one surfactant comprises from about 0.1% dry wt. to about 50% by dry wt. of the microemulsion.

In other aspects of the method, the structured fabric surface comprises a TAD fabric surface, a papermaking belt surface, or a textured or structured belt surface. In preferred embodiments of the method, the structured fabric surface is a TAD fabric surface.

In other aspects of the current method, the adhesion between a tissue web and a structured fabric surface in a tissue making process is reduced. The method involves providing a micro-emulsion of at least one hydrophobic material and two surfactants, wherein the micro-emulsion has a mean particle size of less than about 1 micron. The micro-emulsion is applied directly to the surface of the structured fabric thereby reducing the adhesion between the tissue web and structured fabric surface allowing for a more uniform tissue product.

In yet other aspects of the current method, a micro-emulsion is generated comprising at least two surfactants and at least one hydrophobic agent. The hydrophobic agent can be selected from hydrophobically modified polyethylene glycol, or hydrophobically modified polyaminoamides, or a combination of mineral oils, vegetable oils, fatty acid esters, natural or synthetically derived hydrocarbons, natural or synthetically derived wax, Carnauba wax, hydrolyzed AKD, polyethylene homopolymers, polypropylene homopolymers, ethylene-acrylic acid copolymers, ethylene maleic anhydride copolymers, propylene maleic anhydride copolymers, oxidized polypropylene homopolymers, oxidized polyethylene homopolymers and combinations thereof. The at least two surfactants can be anionic, cationic, or non-ionic as long as a micro-emulsion is created having a mean particle size of less than 1 micron. In preferred embodiments, one the at least two surfactants is non-ionic.

In some aspects, the method includes generating a micro-emulsion comprising a fatty acid tri-ester, a hydrophobically modified aminoamide, a surfactant, and combinations thereof.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

EXAMPLES

In comparative studies, conventional TAD fabric release agents demonstrated inferior release properties compared with the release agents of the current method. The compositions used in the current method provide for superior thermal stability and minimal or non-existent environmental issues.

Example 1

Samples #1 and #2 of Table 1 below, were made by combining a fatty acid triester (Hydrophobe A), a hydrophobically modified polyethylene glycol (HMPEG) (Hydrophobe B), a non-ionic surfactant and DI water. Using a Gaulin Homogenizer and a Microfluidizer, the mixture was heated to 75° C. and forced under a pressure of 4,000 lbs per square inch (psi) through an adjustable orifice producing a micro-emulsion having a mean particle size given in Table 1 below. Samples #3 to #5 were made by combining the fatty acid triester (Hydrophobe A), hydrophobically modified polyethylene glycol (HMPEG) (Hydrophobe B), non-ionic surfactant and DI water at the same temperature regime and blended without being pressurized at 4,000 psi. Samples #3 to #5 was unstable and separated immediately after cooling down to room temperature. Samples #1 and #2 remained stable at room temperature. The particle size of the "micro-emulsions" produced by the Gaulin Homogenizer and Microfluidizer (samples #1 and #2) was less than 0.5 microns, whereas particle size of the regular emulsions, made by blending the components without pressurization, ranged from 20 microns to 97 microns. Results indicated that the emulsions with a particle size of 1.0 micron or lower resulted in significant enhancement of the formulations stability.

TABLE 1

| Sample | Hydrophobe A | Hydrophobe B | Surfactant | Stability (Room Temp.) | Particle Size (micron) |
|---|---|---|---|---|---|
| 1 | H* | 0 | L | Stable after 150 days | 0.46 |
| 2 | H | L** | L | Stable after 150 days | 0.31 |
| 3 | H | 0 | L | Separated immediately | 97.67 |
| 4 | H | L | 0 | Separated immediately | 83.71 |
| 5 | H | L | L | Separated immediately | 20.82 |

H* comprises 50% to 99.9% by dry wt. of the formulation
L** comprises 0.1% to 10% by dry wt. of the formulation

Example 2

The compositions of the present method were evaluated for their ability to reduce adhesion of tissue web to TAD fabric materials thus improving release properties. A number of formulations comprising hydrophobic agents and surfactants were tested on a TAD Fabric Release tester for their ability to reduce adhesion between sheet and the fabric, thus improving release properties. Formulations were tested as aqueous solutions with levels of treatments at 60 milligrams per square meter (mg/m$^2$).

Laboratory evaluations using a TAD simulator (Choi, D., "New Simulation Capability Turns Art into Science for Structured Tissue and Towel Making Processes," Proceeding of Tissue 360° Forum, PaperCon 2013, 2013) demonstrated that Samples #1 and #2 in Table 2 below, provided for surprisingly lower adhesion between the tissue sheet and the structured fabric. Reduction in adhesion was about 30% to 50% lower compared with a conventional fabric release agent (Rezosol®1749). This was achieved by using micro-emulsions with a particle size of the micro-emulsion of about 1 μm or less. Sample #1 is a two component micro-emulsion (containing hydrophobe and surfactant) and provide improvements up to 30% compared with the conventional method and release agent. Sample #2 results showed improvement of fabric release up to 50% compared with the reference product. The synergy among components in a three component micro-emulsion provides for unusual improvement in fabric release.

TABLE 2

| Samples | Basis Wt., grams per square meter (gsm) | Dosage, Milligram per square meter (mg/m$^2$) | Adhesion, (Newton) Average | Adhesion, (Newton) Std. Deviation (S) |
|---|---|---|---|---|
| Reference (No Additives) | 26 | NA | 38.39 | 1.17 |
| Rezosol ® 1749 | 26 | 60 | 32.57 | 0.77 |
| # 1 | 26 | 60 | 20.95 | 2.57 |
| # 2 | 26 | 60 | 18.33 | 1.12 |

Reference—No release product applied.
Rezosol ® 1749—Available fabric release product (base-line)
1—Hydrophobe A plus non-ionic surfactant
2—Hydrophobe A plus Hydrophobe B (HMPEG) plus non-ionic surfactant
** Sample 1 and 2 are the # 1 and # 2 in the Table 1. Samples 3 to 5 were not evaluated as they separated.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

Example 3

The compositions of the present invention were evaluated for their ability to reduce adhesion of tissue to TAD fabric materials. A number of formulations were tested on the TAD Fabric Release tester described above for their ability to reduce adhesion between sheet and the fabric. The formulations were tested as aqueous solutions with levels of treatments of 40 mg/m$^2$.

Laboratory evaluations demonstrated that micro-emulsions #5 and #6 in Table 3 and FIG. 1, provided significantly lower adhesion between the tissue web and the structured fabric. Reduction in adhesion was about 60% compared with the reference that has no chemical additives. Blended emulsions #3 and #4 were not as effective reducing adhesion only 11% to 22% compared with the reference. Micro-emulsions #1 and #2 also significantly reduced adhesion between 40% to 46%, but less effective than those made in combination with a non-ionic surfactant or hydrophobe as is shown in Table 3 and FIG. 2.

TABLE 3

| Sample | Basis Wt., grams per square meter (gsm) | Dosage, milligram per square meter (mg/m$^2$) | Adhesion, Newton (N) Average | Standard Deviation (S) |
|---|---|---|---|---|
| Reference Sample, No Additives | 26 | NA | 38.58 | 1.83 |
| #1 | 26 | 40 | 22.91 | 2.89 |
| #2 | 26 | 40 | 20.80 | 2.49 |
| #3 | 26 | 40 | 30.34 | 3.07 |
| #4 | 26 | 40 | 34.48 | 1.09 |
| #5 | 26 | 40 | 13.73 | 0.14 |
| #6 | 26 | 40 | 13.22 | 0.69 |

Reference: No Additives

#1: Micro-emulsion of Hydrophobe A (fatty acid trimester), non-ionic surfactant and anionic surfactant

#2: Micro-emulsion of Hydrophobe A, non-ionic surfactant and cationic surfactant

#3: Blended emulsion of Hydrophobe A, Hydrophobe B, and non-ionic surfactant

#4: Blended emulsion of Hydrophobe A, Hydrophobe B, and non-ionic surfactant

#5: Micro-emulsion of Hydrophobe A, Hydrophobe B, and non-ionic surfactant

#6: Micro-emulsion of Hydrophobe A, Hydrophobe B, and non-ionic surfactant

Example 4

The compositions of the present method were evaluated to test against compositions with other hydrophobes used in TAD applications and the results presented in Table 4. The compositions comprised one or more of the following: Hydrophobe A (fatty acid tri-ester), Hydrophobe B, hydrophobically modified polyethylene glycol (HMPEG), Hydrophobe C, hydrophobically modified polyvinyl amines (HMPVAM), and Hydrophobe D (mineral oil), Hydrophobe E (vegetable oil), and Hydrophobe F (synthetic oil).

Laboratory evaluation using the TAD simulator and fabric release tester described above, showed that the present method using Hydrophobe B and Hydrophobe C significantly lowered the adhesion between the tissue web and the structured fabric.

TABLE 4

| Sample | Basis Wt. (grams per square meter) | Dosage, milligram per square meter (mg/m$^2$) | Adhesion, Newton (N) Average | Standard Deviation (S) |
|---|---|---|---|---|
| Reference Sample, No Additives | 26 | NA | 33.45 | 1.10 |
| #1 | 26 | 60 | 10.26 | 0.33 |
| #2 | 26 | 60 | 8.86 | 0.93 |
| #3 | 26 | 60 | 13.54 | 0.49 |
| #4 | 26 | 60 | 20.98 | 1.56 |
| #5 | 26 | 60 | 15.25 | 1.29 |

No release: no fabric release agent

#1: Micro-emulsion with Hydrophobe A, Hydrophobe B, and non-ionic surfactant

#2: Micro-emulsion with Hydrophobe A, Hydrophobe C, and non-ionic surfactant

#3: Micro-emulsion with Hydrophobe A, Hydrophobe D, and non-ionic surfactant

#4: Micro-emulsion with Hydrophobe A, Hydrophobe E, and non-ionic surfactant

#5: Micro-emulsion with Hydrophobe A, Hydrophobe F, and non-ionic surfactant

Any references cited in the present application above, including books, patents, published applications, journal articles and other publications, is incorporated herein by reference in its entirety.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method for reducing the adhesion between a tissue web and a surface of a structured fabric in a tissue making process comprising:

providing a micro-emulsion comprising a first hydrophobic agent selected from the group consisting of hydrophobically modified polyethylene glycols, hydrophobically modified polyaminoamides, hydrophobically modified polyvinylamines and combinations thereof, a second hydrophobic agent selected from the group consisting of mineral oils, vegetable oils, fatty acid esters, natural or synthetically derived hydrocarbons, natural or synthetically derived wax, Carnauba wax, hydrolyzed AKD, polyethylene homopolymers, polypropylene homopolymers, ethylene-acrylic acid copolymers, ethylene maleic anhydride copolymers, propylene maleic anhydride copolymers, oxidized polypropylene homopolymers, oxidized polyethylene homopolymers, and combinations thereof; and at least one surfactant; wherein the first hydrophobic agent comprises from about 0.1 wt. % to about 10 wt % of the dry weight of the microemulsion, the second hydrophobic agent comprises from about 50 wt % to about 99.8 wt % of the dry weight of the microemulsion and the surfactant comprises from about 0.1 wt % to about 49.9 wt % of the dry weight of the microemulsion, and wherein the micro-emulsion has a mean particle size of from 1 μm to about 0.1 μm;

applying the resulting micro-emulsion to the surface of the structured fabric;

thereafter, contacting the surface of the structured fabric with the tissue web; and producing a tissue product from the tissue web after contacting the surface of the structured fabric with the tissue web.

2. The method according to claim 1, wherein the first hydrophobic agent, second hydrophobic agent and at least one surfactant are combined and then homogenized to produce the micro-emulsion.

3. The method according to claim 1, wherein the first hydrophobic agent, second hydrophobic agent and at least one surfactant are combined and then homogenized to produce the micro-emulsion having a mean particle size of about 0.5 μm or less.

4. The method according to claim 1, wherein the first hydrophobic agent, second hydrophobic agent and at least one surfactant are combined and then homogenized to produce the micro-emulsion having a mean particle size of about 0.3 μm or less.

5. The method according to claim 1, wherein the second hydrophobic agent is a fatty acid tri-ester.

6. The method according to claim 5, wherein the first hydrophobic agent is a hydrophobically modified polyethylene glycol.

7. The method according to claim 1, wherein the at least one surfactant is selected from the group consisting of a linear alcohol ethoxylate, branched alcohol ethoxylate, polyethylene glycol mono or diester fatty acid, polyethylene glycol alkyl ether, and combinations thereof.

8. The method according to claim 7, wherein the structured fabric surface is a TAD fabric surface.

9. The method according to claim 1, wherein the structured fabric surface is selected from the group consisting of a TAD fabric surface, a papermaking belt surface, a textured belt or a structured belt surface.

10. The method according to claim 1, wherein the first hydrophobic agent is selected from hydrophobically modified polyethylene glycols, hydrophobically modified polyaminoamides.

11. A method for reducing the adhesion between a tissue web and a structured fabric surface in a tissue making process comprising:

providing a micro-emulsion comprising a first hydrophobic agent selected from the group consisting of hydrophobically modified polyethylene glycols, hydrophobically modified polyaminoamides, hydrophobically modified polyvinylamines and combinations thereof, a second hydrophobic agent selected from the group consisting of mineral oils, vegetable oils, fatty acid esters, natural or synthetically derived hydrocarbons, natural or synthetically derived wax, Carnauba wax, hydrolyzed AKD, polyethylene homopolymers, polypropylene homopolymers, ethylene-acrylic acid copolymers, ethylene maleic anhydride copolymers, propylene maleic anhydride copolymers, oxidized polypropylene homopolymers, oxidized polyethylene homopolymers, and combinations thereof; and first and second surfactant; wherein the first hydrophobic agent comprises from about 0.1 wt. % to about 10 wt % of the dry weight of the microemulsion, the second hydrophobic agent comprises from about 50 wt % to about 99.8 wt % of the dry weight of the microemulsion and the first and second surfactant comprise from about 0.1 wt % to about 49.9 wt % of the dry weight of the microemulsion, and wherein the micro-emulsion has a mean particle size of from 1 μm to about 0.1 m;

applying the resulting micro-emulsion to the surface of the fabric;

thereafter, contacting the surface of the structured fabric with the tissue web; and producing a tissue product from the tissue web after contacting the surface of the structured fabric with the tissue web.

12. The method according to claim 11, wherein the first and second surfactant are selected from the group consisting of a linear alcohol ethoxylate, branched alcohol ethoxylate, polyethylene glycol mono or diester fatty acid, polyethylene glycol alkyl ether, and combinations thereof.

13. A method of making tissue comprising:

providing a micro-emulsion comprising a first hydrophobic agent selected from the group consisting of hydrophobically modified polyethylene glycols, hydrophobically modified polyaminoamides, hydrophobically modified polyvinylamines and combinations thereof, a second hydrophobic agent selected from the group consisting of mineral oils, vegetable oils, fatty acid esters, natural or synthetically derived hydrocarbons, natural or synthetically derived wax, Carnauba wax, hydrolyzed AKD, polyethylene homopolymers, polypropylene homopolymers, ethylene-acrylic acid copolymers, ethylene maleic anhydride copolymers, propylene maleic anhydride copolymers, oxidized polypropylene homopolymers, oxidized polyethylene homopolymers, and combinations thereof; and at least one surfactant; wherein the first hydrophobic agent comprises from about 0.1 wt. % to about 10 wt % of the dry weight of the microemulsion, the second hydrophobic agent comprises from about 50 wt % to about 99.8 wt % of the dry weight of the microemulsion and the surfactant comprises from about 0.1 wt % to about 49.9 wt % of the dry weight of the microemulsion, and wherein the micro-emulsion has a mean particle size of from 1 μm to about 0.1 μm;

applying the resulting micro-emulsion to the surface of a structured fabric;

thereafter, contacting the surface of the structured fabric with a tissue web;

and producing a tissue product from the tissue web after contacting the surface of the structured fabric with the tissue web.

* * * * *